US011198596B2

(12) United States Patent
Mizuki et al.

(10) Patent No.: US 11,198,596 B2
(45) Date of Patent: Dec. 14, 2021

(54) CRANE

(71) Applicant: TADANO LTD., Kagawa (JP)

(72) Inventors: Kazuma Mizuki, Kagawa (JP); Hiroyuki Hayashi, Kagawa (JP)

(73) Assignee: TADANO LTD., Kagawa (JP)

( * ) Notice: Subject to any disclaimer, the term of this patent is extended or adjusted under 35 U.S.C. 154(b) by 29 days.

(21) Appl. No.: 16/967,537

(22) PCT Filed: May 27, 2019

(86) PCT No.: PCT/JP2019/020939
§ 371 (c)(1),
(2) Date: Aug. 5, 2020

(87) PCT Pub. No.: WO2020/012798
PCT Pub. Date: Jan. 16, 2020

(65) Prior Publication Data

US 2021/0214194 A1 Jul. 15, 2021

(30) Foreign Application Priority Data

Jul. 10, 2018 (JP) ..... JP2018-131035

(51) Int. Cl.
*B66C 13/22* (2006.01)
*B66C 13/00* (2006.01)
(Continued)

(52) U.S. Cl.
CPC ..... *B66C 13/22* (2013.01); *B66C 13/00* (2013.01); *B66C 13/40* (2013.01); *B66C 23/42* (2013.01); *B66C 2700/0371* (2013.01)

(58) Field of Classification Search
CPC ..... B66C 13/00; B66C 13/22; B66C 13/40; B66C 13/46; B66C 13/48; B66C 23/88
See application file for complete search history.

(56) References Cited

U.S. PATENT DOCUMENTS

2007/0118282 A1* 5/2007 Yamamoto ..... G08G 1/163 701/1
2008/0275610 A1* 11/2008 Terashima ..... B66C 13/063 701/50

FOREIGN PATENT DOCUMENTS

JP 2007-141179 A 6/2007
JP 2011-045167 A 3/2011
(Continued)

OTHER PUBLICATIONS

Machine Translation JP 2015/196403A (Foreign Reference previously provided by Applicant). (Year: 2015).*
(Continued)

*Primary Examiner* — Michael R Mansen
*Assistant Examiner* — Juan J Campos, Jr.
(74) *Attorney, Agent, or Firm* — Paratas Law Group, PLLC

(57) ABSTRACT

The present invention addresses the problem of providing a crane that can ascertain the state of an area surrounding a hook or a cargo suspended on the hook and that can simultaneously ascertain a braking distance during stopping operations. The invention comprises: drive devices 31-34 that move a boom 7; a control apparatus 20 that controls the operation state of the drive devices 31-34; a camera 41 that photographs, from the distal end portion of the boom 7, an area below said portion; and image display devices 43 and 65 that display the image photographed by the camera 41. For the purpose of stopping the movement of the boom 7, the control apparatus 20 filters basic control signals S for the drive devices 31-34 to create filtered control signals Sf, controls the drive devices 31-34 on the basis of the filtered control signals Sf, estimates the braking distance for the boom 7, and displays the same on the image display devices 43 and 65.

5 Claims, 12 Drawing Sheets

(51) Int. Cl.
*B66C 13/40* (2006.01)
*B66C 23/42* (2006.01)

(56) References Cited

FOREIGN PATENT DOCUMENTS

| | | | | |
|---|---|---|---|---|
| JP | 2015-151211 | A | 8/2015 | |
| JP | 2015-196403 | A | 11/2015 | |
| WO | WO 2005/012155 | A1 | 2/2005 | |
| WO | WO-2019066018 | A1 * | 4/2019 | ..... B66C 13/066 |

OTHER PUBLICATIONS

Machine Translation JP 2011/045167A (Foreign Reference previously provided by Applicant). (Year: 2011).*
Machine Translation JP 2007/141179A (Foreign Reference previously provided by Applicant). (Year: 2007).*
Machine Translation JP 2015/151211A (Foreign Reference previously provided by Applicant). (Year: 2015).*
Machine Translation WO 2005/012155 A1. (Foreign Reference previously provided by Applicant). (Year: 2005).*
Machine Translation WO 2019/066018 A1. (Year: 2019).*
Jul. 9, 2019, International Search Report issued for related PCT Application No. PCT/JP2019/020939.
Jul. 9, 2019, International Search Opinion issued for related PCT Application No. PCT/JP2019/020939.

* cited by examiner

CRANE

CROSS REFERENCE TO PRIOR APPLICATION

This application is a National Stage Patent Application of PCT International Patent Application No. PCT/JP2019/020939 (filed on May 27, 2019) under 35 U.S.C. § 371, which claims priority to Japanese Patent Application No. 2018-131035 (filed on Jul. 10, 2018), which are all hereby incorporated by reference in their entirety.

TECHNICAL FIELD

The present invention relates to cranes. The present invention particularly relates to a crane capable of grasping the surrounding conditions of a hook or a load suspended on a hook and at the same time grasping the braking distance at the time of stopping operation.

BACKGROUND ART

Conventionally, cranes are known to be typical working vehicles. The crane is mainly composed of a traveling body and a swivel body. The traveling body is provided with a plurality of wheels and is configured to travel freely. The swivel body is provided with a wire rope and a hook in addition to a boom, and is configured to carry a load freely. In such a crane, a driving device for performing the operation of the boom, and a control apparatus for controlling the operating state of the driving device are provided.

A crane has been proposed in which the control apparatus creates a filtered control signal and the driving device is controlled based on the filtered control signal (see Patent Literature 1). Here, the filtered control signal is obtained by applying a filter having a predetermined characteristic to the basic control signal of the driving device. For example, the notch filter has a characteristic that the attenuation rate becomes higher as it approaches the resonance frequency in any range centered on the resonance frequency.

Here, it is assumed that the operation of stopping the swivel motion of the boom is performed and the hook or the load suspended on the hook is stopped. In this case, even if the operator performs the operation of stopping the swivel motion of the boom, the boom continues the swivel motion while decelerating for a while. Instead of immediately stopping the swivel motion of the boom, this is intended to suppress the swing of the load by providing a deceleration period based on the filtered control signal. However, a longer braking distance of the boom increases the possibility that the hook or the load suspended on a hook will collide with a building or the like. Therefore, the crane capable of grasping the surrounding conditions of the hook or the load suspended on the hook and at the same time grasping the braking distance at the time of stopping operation was required.

CITATION LIST

Patent Literature

PTL 1

Japanese Patent Application Laid-Open No. 2015-151211

SUMMARY OF INVENTION

Technical Problem

This application relates to the crane capable of grasping the surrounding conditions of the hook or the load suspended on the hook and at the same time grasping the braking distance at the time of stopping operation.

Solution to Problem

The present invention is a crane comprising:

a boom;

a wire rope hanging from the boom; and a hook ascending and descending by winding and unwinding of the wire rope;

wherein the crane is configured to transport a load while suspending the load on the hook, wherein the crane comprises:

a driving device for performing a motion of the boom;

a control apparatus for controlling an operating state of the driving device;

a camera for taking an image downward from a distal end portion of the boom; and an image display for displaying the image taken by the camera;

wherein in a case where the motion of the boom is stopped, the control apparatus generates a filtered control signal by applying a filter to a basic control signal of the driving device and controls the driving device based on the filtered control signal, and predicts a braking distance of the boom to display the braking distance thereof on the image display.

In the present invention, the control apparatus predicts a position at which the load stops and displays a marker of the load on the image display.

In the present invention, the control apparatus predicts a swing amount of the load and displays a swing range of the load on the image display.

In the present invention, the control apparatus predicts a position at which the hook stops and displays a marker of the hook on the image display.

In the present invention, the control apparatus predicts a swing amount of the hook and displays a swing range of the hook on the image display.

Advantageous Effects of Invention

According to the crane of the present invention, a driving device for performing a motion of the boom, a control apparatus for controlling an operating state of the driving device, a camera for taking an image downward from a distal end portion of the boom and an image display for displaying the image taken by the camera are provided. In a case where the motion of the boom is stopped, the control apparatus generates a filtered control signal by applying a filter to a basic control signal of the driving device and controls the driving device based on the filtered control signal, and predicts a braking distance of the boom to display the braking distance thereof on the image display. According to such a crane, an operator can grasp the surrounding condition of the hook or the load suspended on the hook by viewing the image display, and at the same time, can grasp the braking distance of the boom. It is thus possible to perform an avoidance operation before the hook or the load suspended on a hook collides with a building or the like.

According to the crane of the present invention, the control apparatus predicts the position at which the load stops and displays the marker of the load on the image display. According to such a crane, it is possible to easily determine whether the load collides with a building or the like from the displayed marker of the load. Therefore, it is possible to perform the avoidance operation before the load collides with a building or the like.

According to the crane of the present invention, the control apparatus predicts a swing amount of the load and displays a swing range of the load on the image display. According to such a crane, it is possible to easily determine whether the load collides with a building or the like from the displayed swing range of the load. Therefore, it is possible to perform the avoidance operation before the load collides with a building or the like.

According to the crane of the present invention, the control apparatus predicts a position at which the hook stops and displays a marker of the hook on the image display. According to such a crane, it is possible to easily determine whether the hook collides with a building or the like from the displayed marker of the hook. Therefore, it is possible to perform the avoidance operation before the hook collides with a building or the like.

According to the crane of the present invention, the control apparatus predicts a swing amount of the hook and displays a swing range of the hook on the image display. According to such a crane, it is possible to easily determine whether the hook collide with a building or the like from the displayed swing range of the hook. Therefore, it is possible to perform the avoidance operation before the hook collides with a building or the like.

DESCRIPTION OF EMBODIMENT

Figure 1:
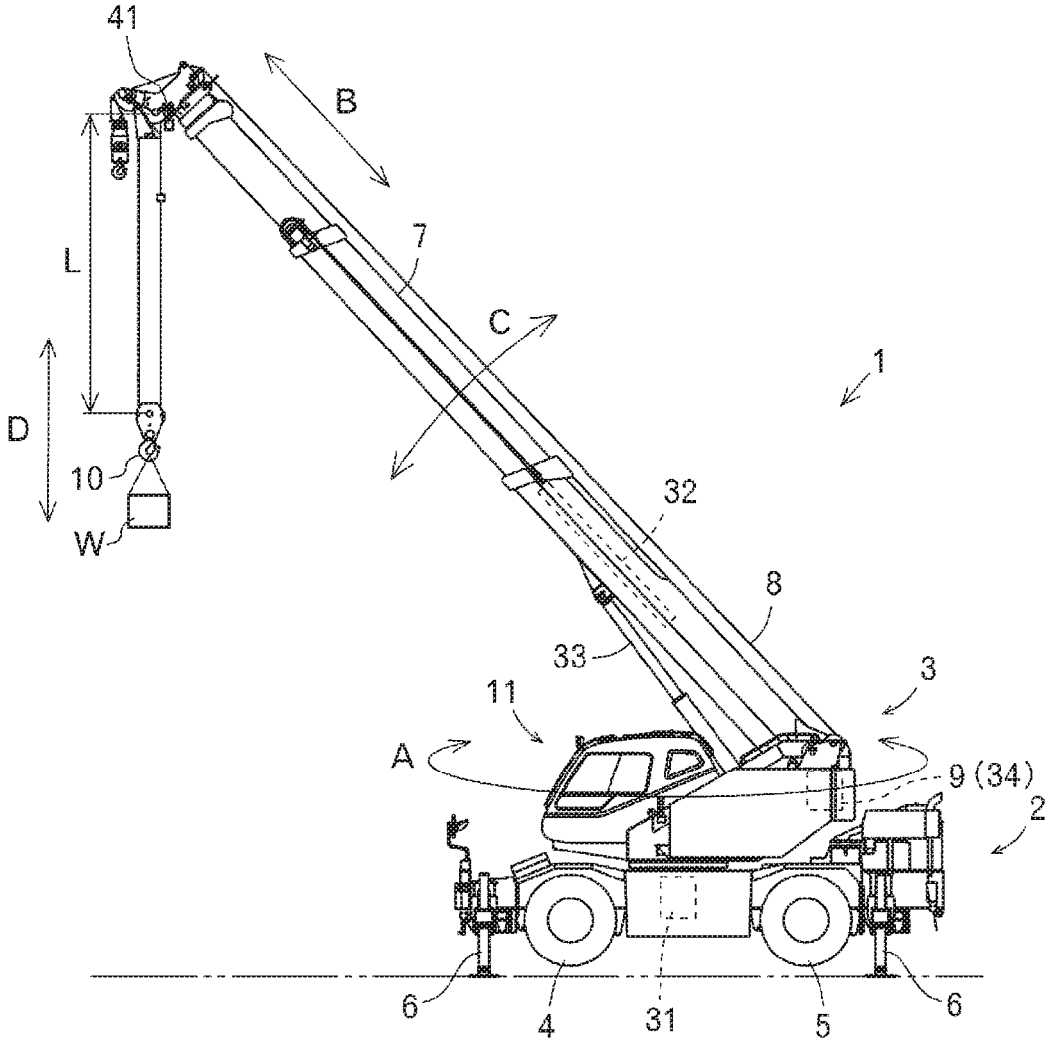
FIG. 1 illustrates a crane.

The technical idea disclosed in the present application can be applied to other cranes as well as crane 1 described below.

First, with reference to FIGS. 1 and 2, crane 1 will be described.

Crane 1 is mainly composed of traveling body 2 and swivel body 3.

Traveling body 2 includes a pair of left and right front wheels 4 and rear wheels 5. In addition, traveling body 2 is provided with outrigger 6 which is grounded to stabilize when carrying load V. It should be noted that traveling body 2 supports pivot body 3, which is swivelable by the driving device, on the upper portion thereof.

Swivel body 3 is provided with boom 7 so as to protrude forward from the rear portion of swivel body 3. Therefore, boom 7 is swivelable by the driving device (see arrow A). Further, boom 7 is extendible and retractable by the driving device (see arrow B). Further, boom 7 is luffing-free by the driving device (see arrow C). In addition, wire rope 8 is stretched over boom 7. On the proximal end side of boom 7, winch 9 around which wire rope 8 is wrapped is disposed, on the distal end side of boom 7, hook 10 is suspended by wire rope 8. Winch 9 is integrally configured with the driving device to allow winding and unwinding of wire rope 8. Therefore, the hook 10 is movable up and down by the driving device (see arrow D). It should be noted that swivel body 3 is provided with cabin 11 on the side of boom 7. Inside of cabin 11, swivel manipulation tool 21, extension/retraction manipulation tool 22, idling manipulation tool 23, winding manipulation tool 24, to be described later, is provided. Image display 43 described later is also provided.

Figure 3:
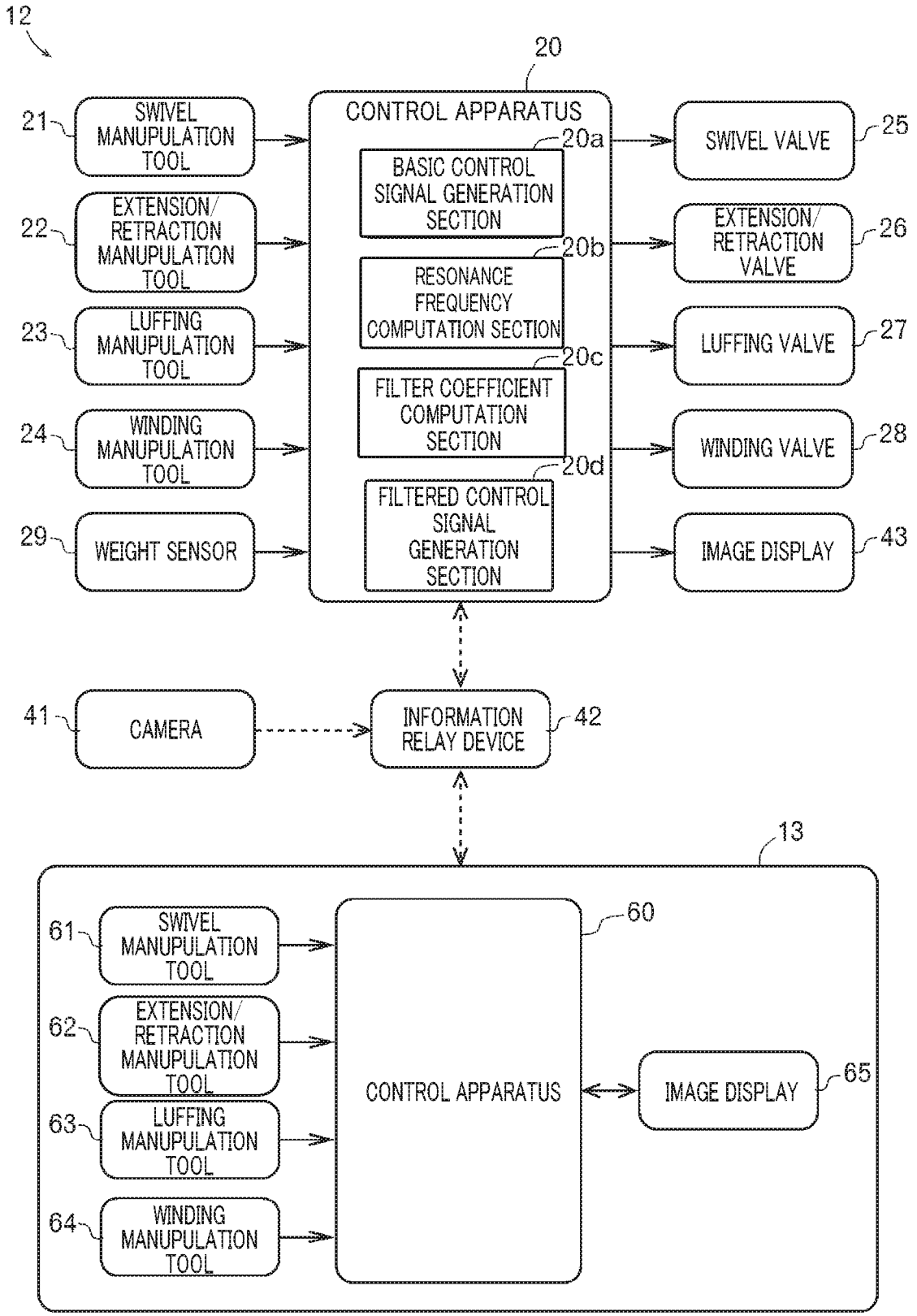
FIG. 3 illustrates a configuration of an operation system.
Figure 4:
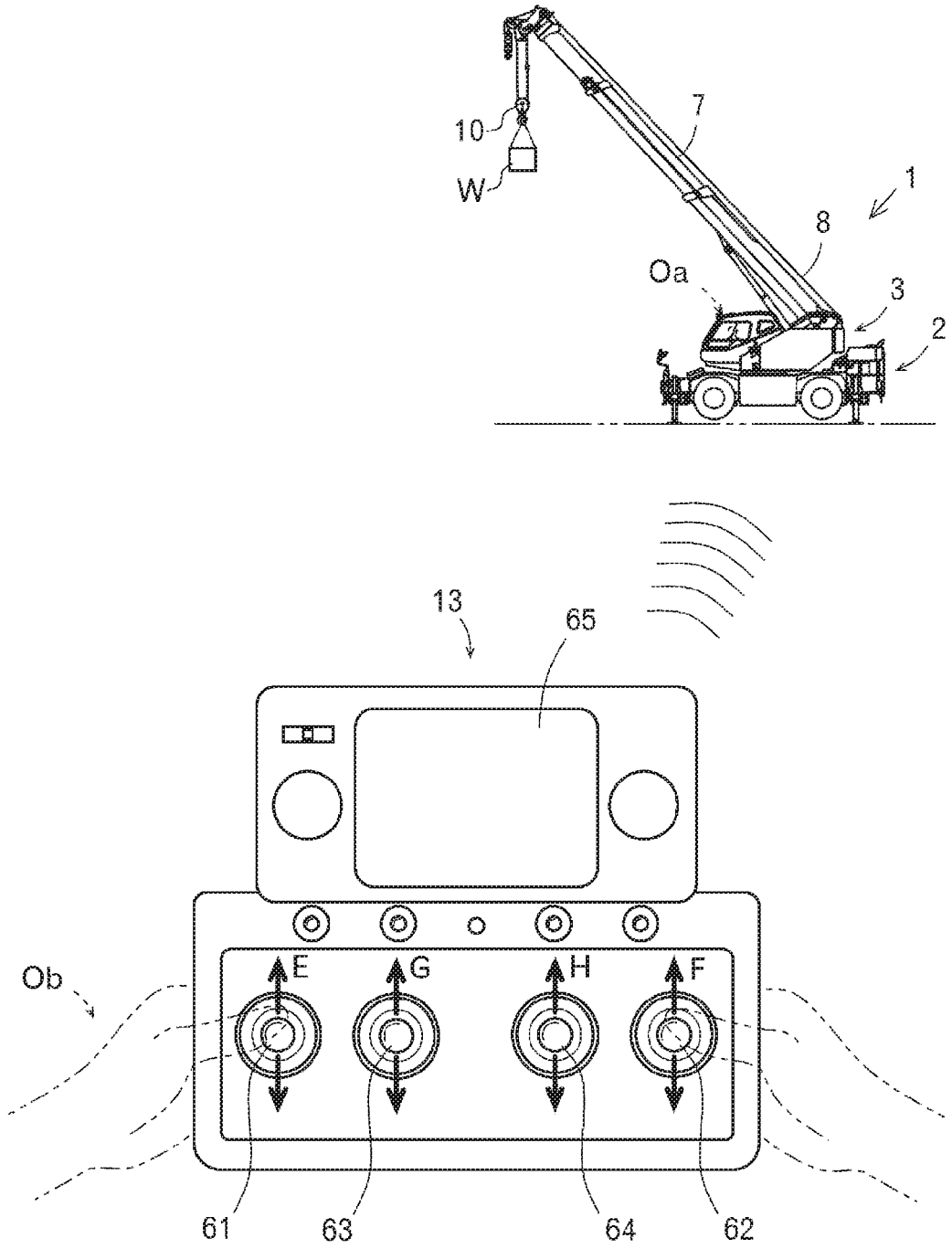
FIG. 4 illustrates a remote operating terminal.

Next, operation system 12 will be described with reference to FIGS. 3 and 4. However, the present operation system is an example of a conceivable configuration, and is not limited thereto. Hereinafter, an operator who performs an operation in crane 1 will be referred to as an "operator Oa," and an operator who performs an operation without riding on crane 1 will be described as an "operator Ob."

Operation system 12 is mainly composed of control apparatus 20. Various manipulating tools 21 to 24 are connected to control apparatus 20. Further, various valves 25 to 28 are connected to control apparatus 20. In addition, weight sensor 29 is connected to control apparatus 20. Weight sensor 29 can detect the weight of load W. Therefore, control apparatus 20 can recognize the weight of load W.

Figure 2:
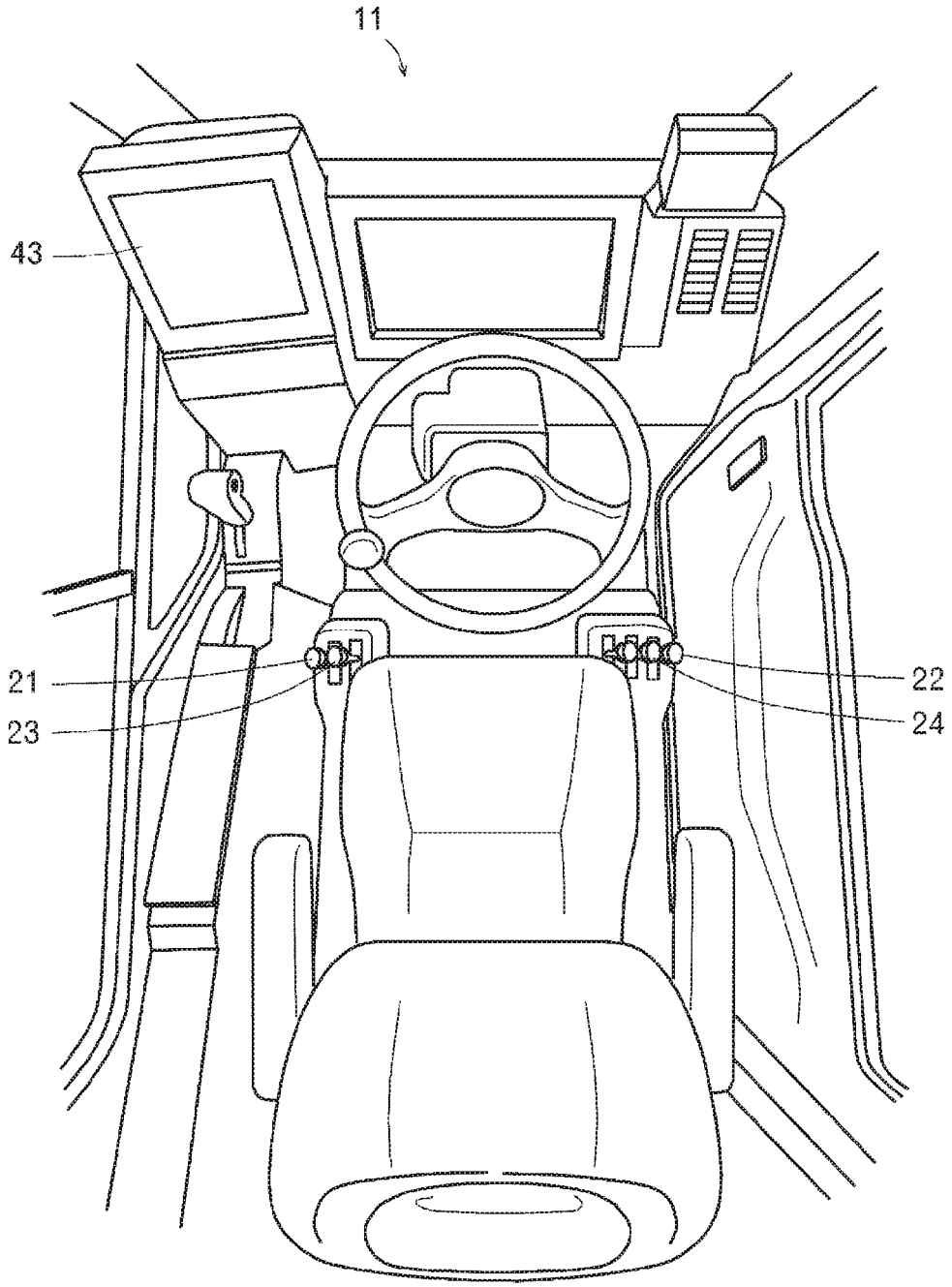
FIG. 2 illustrates an inside of a cabin.

As described above, boom 7 is swivelable by the driving device (see arrow A in FIG. 1). In the present application, such a driving device is defined as swivel hydraulic motor 31. Swivel hydraulic motor 31 is appropriately operated by swivel valve 25 which is a directional control valve. In other words, swivel hydraulic motor 31 is appropriately operated by switching the flow direction of the hydraulic oil with swivel valve 25. Swivel valve 25 is operated based on the operation of swivel manipulation tool 21 by operator Oa. Further, the swivel angle and the swivel speed of boom 7 is detected by a sensor which is not shown. Therefore, control apparatus 20 can recognize the swivel angle and the swivel speed of boom 7.

Further, as described above, boom 7 is extendible and retractable by the driving device (see arrow B in FIG). In the present application, such a driving device is defined as extension/retraction hydraulic cylinder 32. Extension/retraction hydraulic cylinder 32 is appropriately operated by extension/retraction valve 26 which is a directional control valve. In other words, extension/retraction hydraulic cylinder 32 is appropriately operated by switching the flow direction of the hydraulic oil with extension/retraction valve 26. Extension/retraction valve 26 is operated based on the operation of extension/retraction manipulation tool 22 by operator Oa. Further, the extension/retraction length and the extension/retraction speed of boom 7 are detected by a sensor which is not shown. Therefore, control apparatus 20 can recognize the extension/retraction length and the extension/retraction speed of boom 7.

Further, as described above, boom 7 is luffing-free by the driving device (see arrow C in FIG. 1). In the present application, such a driving device is defined as a luffing hydraulic cylinder 33. Luffing hydraulic cylinder 33 is appropriately operated by luffing valve 27 which is a directional control valve. In other words, luffing hydraulic cylinder 33 is appropriately operated by switching the flow direction of the hydraulic oil with luffing valve 27. Luffing valve 27 is operated based on the operation of luffing manipulation tool 23 by operator Oa. Further, the tufting angle and the luffing speed of boom 7 is detected by a sensor which is not shown. Therefore, control apparatus 20 can recognize the luffing angle and the luffing speed of boom 7.

In addition, as described above, hook 10 is movable up and down by the driving device (see arrow D in FIG). In the present application, such a drive device is defined as winding hydraulic motor 34. Winding hydraulic motor 34 is appropriately operated by winding valve 28 which is a directional control valve. In other words, winding hydraulic motor 34 is appropriately operated by switching the flow direction of the hydraulic oil or adjusting the flow rate of the hydraulic oil with winding valve 28. Winding valve 28 is operated based on the operation of winding manipulation tool 24 by operator Oa. Further, slinging length L (see FIG. 1) and the ascending/descending speed of hook 10 is detected by a sensor which is not shown. Therefore, control apparatus 20 can recognize slinging length L and the ascending/descending speed of hook 10.

In addition, operating system 12 includes camera 41, information relay device 42, and image display 43. However, information relay device 42 is unnecessary in a case where remote operating terminal 13 is of a wired type.

Camera 41 is for taking an image. The camera 41 is attached to the distal end portion of boom 7 in order to take an image of hook 10 or load W suspended on hook 10 from above (see FIG. 1). Camera 41 is connected to information relay device 42.

Information relay device 42 transmits and receives information converted into a radio wave signal. Information relay device 42 has at least an antenna attached to the distal end portion of boom 7 in order to reduce the influence on the radio waves due to grounded objects or the like. Information relay device 42, in addition to control apparatus 20, is connected to control apparatus 60 of remote operating terminal 13 to be described later. Therefore, information relay device 42 can transmit information from control apparatus 20 to control apparatus 60. Information relay device 42 may also transmit information from control apparatus 60 to control apparatus 20. Further, the image taken by camera 51 can be transmitted to control apparatus 20 and control apparatus 60.

Image display 43 displays various images. Image display 43 is attached to the front side of cabin 11 so that operator Oa can visually recognize the image while manipulating various manipulation tools 21 to 24. Image display 43 is connected to control apparatus 20. Therefore, control apparatus 20 can provide information to operator Oa via image display 43.

In addition, operating system 12 includes remote operating terminal 13. Remote operating terminal 13 is provided with control apparatus 60. Further, remote operating terminal 13 includes a transmitter and a receiver which are not shown. Remote operating terminal 13 in the present application is an example of a remote operating terminal, and is not limited thereto.

Remote operating terminal 13 is provided with swivel manipulation tool 61. Swivel manipulation tool 61 is connected to control apparatus 60. Then, control apparatus 60 is connected to control apparatus 20 described above via a radio wave signal. Therefore, when operator Ob tilts swivel manipulation tool 61 in a direction (see arrow E in FIG. 4), the swivel motion of boom 7 is performed in the same manner as the swivel manipulation tool 21 is tilted in a direction described above. That is, when operator Ob tilts swivel manipulation tool 61 in a direction, swivel hydraulic motor 31 is appropriately operated, so that boom 7 is swiveled in the right or left direction.

Remote operating terminal 13 is provided with extension/retraction manipulation tool 62. Extension/retraction manipulation tool 62 is connected to control apparatus 60. Then, control apparatus 60 is connected to control apparatus 20 described above via a radio wave signal. Therefore, when operator Ob tilts extension/retraction manipulation tool 62 in a direction (see arrow F in FIG. 4), the extension retraction operation of boom 7 is performed in the same manner as extension/retraction manipulation tool 22 is tilted in a direction described above. That is, when operator Ob tilts extension/retraction manipulation tool 62 in a direction, extension/retraction hydraulic cylinder 32 is appropriately operated, so that boom 7 is extended or retracted.

Further, remote operating terminal 13 is provided with luffing manipulation tool 63. Lulling manipulation tool 63 is connected to control apparatus 60. Then, control apparatus 60 is connected to control apparatus 20 described above via a radio wave signal. Therefore, when operator Ob tilts tufting manipulation tool 63 in a direction (see arrow G in FIG. 4), the luffing operation of boom 7 is performed in the same manner as luffing manipulation tool 23 is tilted in a direction described above. That is, when the operator Ob tilts the luffing operation tool 63 in any direction, the luffing hydraulic cylinder 33 is appropriately operated, so that boom 7 is luffed up or down.

In addition, remote operating terminal 13 is provided with winding manipulation tool 64. Winding manipulation tool 64 is connected to control apparatus 60. Then, control apparatus 60 is connected to control apparatus 20 described above via a radio wave signal. Therefore, when operator Ob tilts winding manipulation tool 64 in a direction (see arrow H in FIG. 4), the ascending/descending motion of hook 10 is performed in the same manner as winding manipulation tool 24 is tilted in a direction described above. That is, when operator Ob tilts winding manipulation tool 64 in a direction, winding hydraulic motor 34 is appropriately operated, so that hook 10 is moved up or down.

In addition, remote operating terminal 13 is provided with an image display 65. Image display 65 is connected to control apparatus 60. Then, control apparatus 60 is connected to control apparatus 20 via a radio wave signal described above. Therefore, control apparatus 20 can provide information to operator Ob via image display 65. On the other hand, since image display 65 is a so-called touch panel, it can be the input device of operator Ob. Therefore, operator Ob can also provide information to control apparatus 20 via image display 65. Image display 65 is attached to the front surface of remote operating terminal 13 so that operator Ob can visually recognize the image while manipulating the various manipulation tools 61 to 64.

Thus, remote operating terminal 13 can operate each driving device (31-34) via control apparatus 20. It should be noted that control apparatus 20 includes basic control signal generation section 20*a*, resonance frequency computation section 20*b*, filter coefficient computation section 20*c*, and filtered control signal generation section 20*d*.

Figure 6:
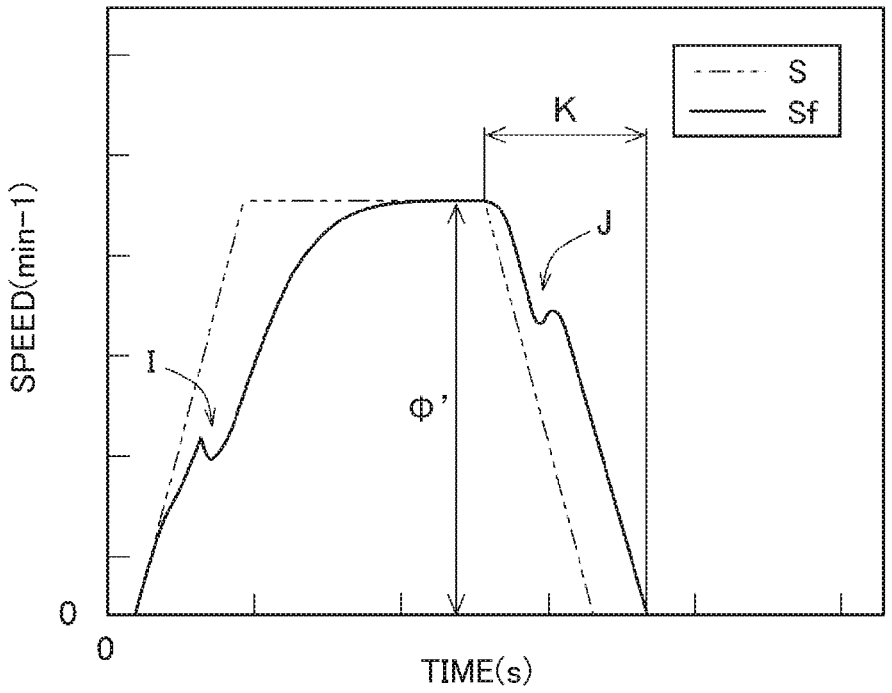
FIG. 6 illustrates a basic control signal and a filtered control signal.

The basic control signal generation section 20*a* generates basic control signal S which is a speed command of each driving device (31 to 34) (see FIG. 6). The basic control signal generation section 20*a* recognizes the manipulated amount and the manipulated speed of various manipulation tools 21 to 24, 61 to 64 by the operator, and generates basic control signal S for each situation. Specifically, basic control signal generation section 20*a* generates basic control signal S corresponding to the manipulated amount and the manipulated speed of swivel manipulation tool 21, 61, basic control signal S corresponding to the manipulated amount and the manipulated speed of extension/retraction manipulation tool 22, 62, basic control signal S corresponding to the manipulated amount and the manipulated speed of luffing manipulation tool 23, 63, and basic control signal S corresponding to the manipulated amount and the manipulated speed of winding manipulation tool 24, 64.

Resonance frequency computation section 20*b* computes resonance frequency ω which is the frequency of the swing of load W caused by the operation of each driving device (31 to 34). Resonance frequency computation section 20*b* recognizes slinging length L of hook 10 based on the posture of boom 7 and the unwinding amount of wire rope 8, and calculates resonance frequency ω for each situation. Specifically, resonance frequency computation section 20*b* calculates resonance frequency ω based on the following equation using slinging length L and gravity acceleration g of hook 10.

$$\omega=\sqrt{(g/L)} \quad \text{[Equation 1]}$$

Filter coefficient computation section 20*c* calculates notch width coefficient ζ and notch depth coefficient δ in addition to center frequency coefficient $\omega_n$ of transfer coefficient H(s) of notch filter F, which will be described later. Filter coefficient computation section 20*c* calculates corresponding center frequency coefficient $\omega_n$ centered on resonance frequency ω calculated by resonance frequency computation section 20*b*. Further, filter coefficient computation section 20*c* calculates notch width coefficient ζ and notch depth coefficient δ corresponding to respective basic control signal S. Transfer coefficient H(s) is expressed by the following equation using center frequency coefficient $\omega_n$, notch width coefficient ζ and notch depth coefficient δ.

$$H(s)=\frac{s^2+2\delta\zeta\omega_n s+\omega_n^2}{s^2+2\zeta\omega_n s+\omega_n^2} \quad \text{[Equation 2]}$$

Filtered control signal generation section 20*d*, along with generating notch filter F, is intended to generate filtered control signal Sf by applying notch filter F to basic control signal S (see FIG. 6). Filtered control signal generation section 20*d* acquires various coefficients $\omega_n$, ζ, δ from filter coefficient computation section 20*c* to generate notched filter F. Further, filtered control signal generation section 20*d* acquires basic control signal S from basic control signal generation section 20*a* to generate filtered control signal Sf by applying notch filter F to basic control signal S. Specifically, filtered control signal generation section 20*d* generates filtered control signal Sf from basic control signal S and notch filter F corresponding to the manipulated amount or the like of swivel manipulation tool 21, 61, filtered control signal Sf from basic control signal S and notch filter F corresponding to the manipulated amount or the like of extension/retraction manipulation tool 22, 62, filtered control signal Sf from basic control signal S and notch filter F corresponding to the manipulated amount or the like of luffing manipulation tool 23, 63, and filtered control signal Sf from basic control signal S and notch filter F corresponding to the manipulated amount or the like of winding manipulation tool 24, 64.

With such a configuration, control apparatus 20 can control various valves 25-28 based on filtered control signal Sf. Thus, each driving device (31-34) can be controlled based on filtered control signal Sf.

Figure 5:
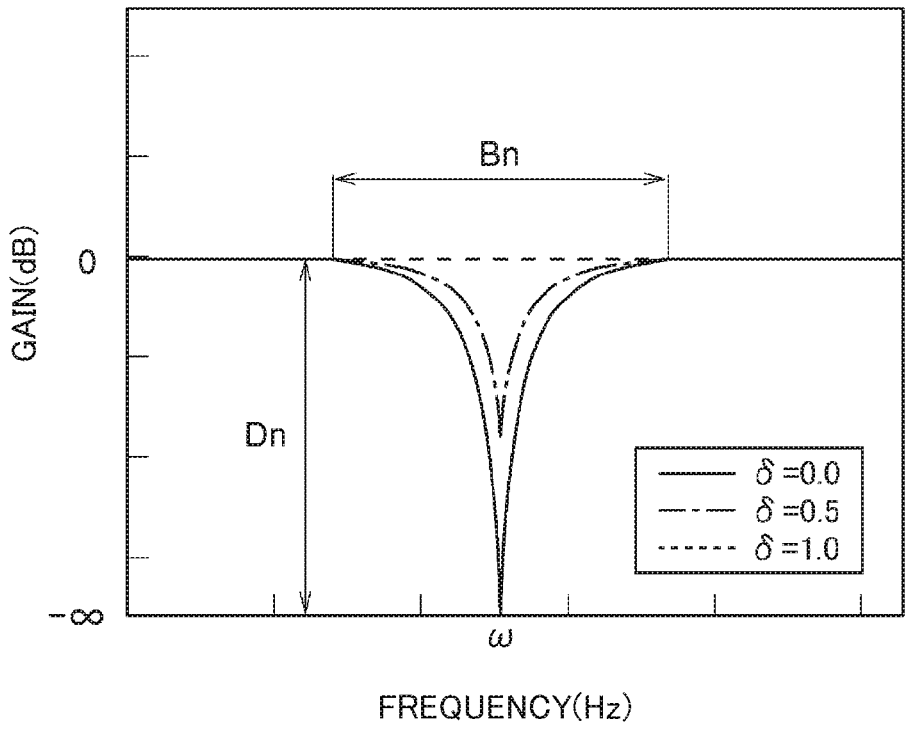
FIG. 5 illustrates a graph indicating frequency characteristics of the notch filter.

Next, with reference to FIGS. 5 and 6, notch filter F and filtered control signal Sf will be described.

Notch filter F has a characteristic in which the attenuation rate becomes higher as it approaches resonance frequency ω in any range centered on resonance frequency ω. Any range centered on resonant frequency ω is represented as notch width Bn, the difference in the attenuation amount in notch width Bn is represented as notch depth Dn. Therefore, notch filter F is specified by resonance frequency ω, notch width Bn and notch depth Dn. Notch depth Dn is intended to be determined based on notch depth coefficient δ. Therefore, in a case where notch depth factor δ=0, the gain characteristic at resonant frequency ω becomes −∞ dB, and in a case where notch depth factor δ=1, the gain characteristic at the resonant frequency ω becomes 0 dB.

Filtered control signal Sf is a speed command transmitted to each driving device (31-34). Filtered control signal Sf according to the acceleration of boom 7 has a characteristic in which the acceleration of filtered control signal Sf is milder than that of basic control signal S, and it accelerates again after temporarily decelerating (see part I in FIG. 6). Here, the reason why the deceleration is temporarily performed is to suppress the swing of load W at the time of acceleration. Further, filtered control signal Sf according to the deceleration of boom 7 has a characteristic in which the deceleration of filtered control signal Sf is milder or comparable than that of basic control signal S, and it decelerates again after temporarily accelerating (see section J in FIG. 6). Here, the reason why the acceleration is temporarily performed is to suppress the swing of load W at the time of deceleration. It should be noted that control apparatus 20 can calculate time K which is the time until the speed command becomes 0 after operator Oa, Ob performs the stop operation. Therefore, control apparatus 20 can predict the braking distance of boom 7 by utilizing time K, the speed transition, resonance frequency ω, and the like. However, it is also possible to predict the braking distance by other mathematical methods without utilizing time K.

Figure 7:
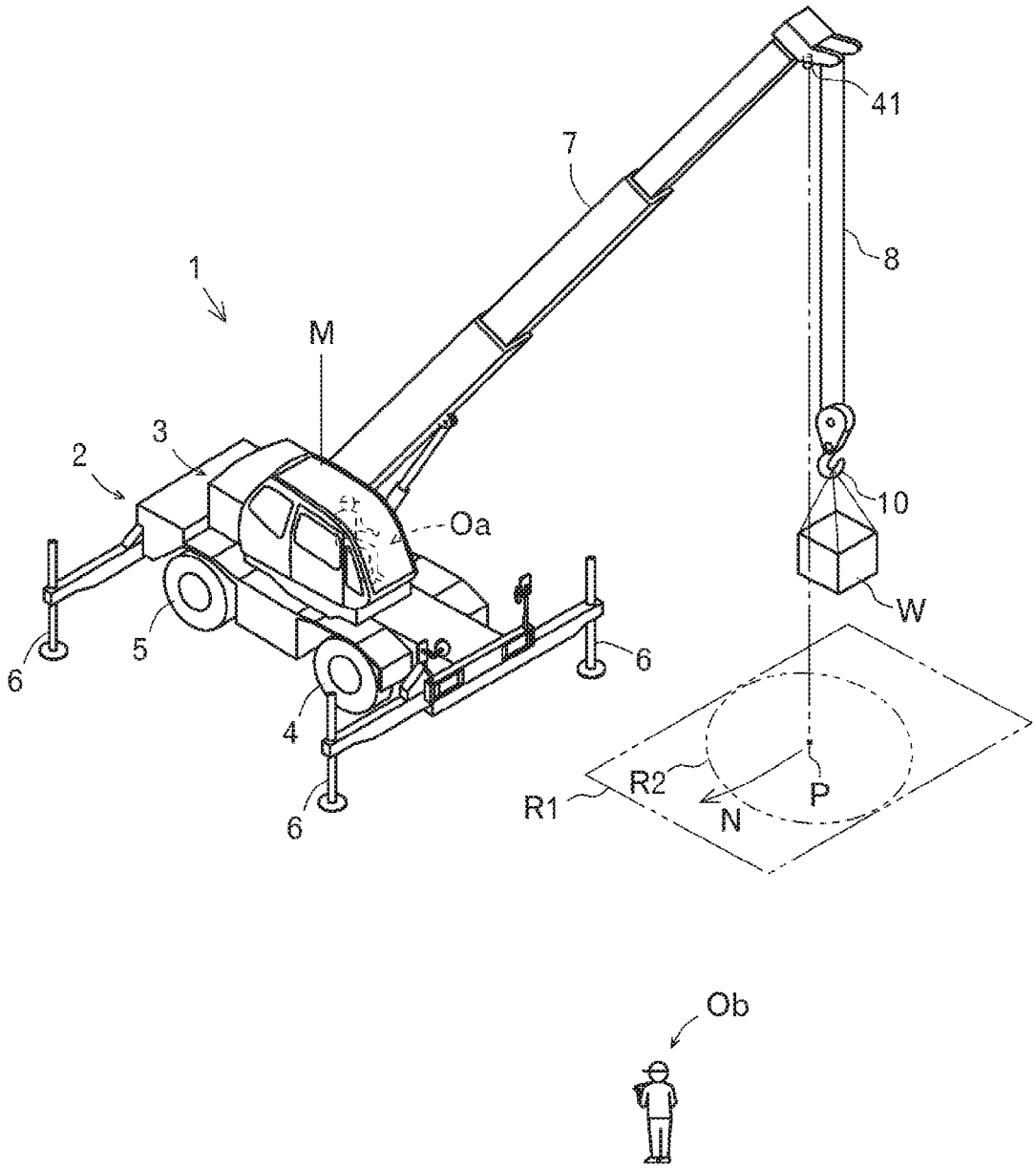
FIG. 7 illustrates a swivel motion of a boom.

Next, with reference to FIGS. 7 to 9, a display mode of image display 43, 65 will be described. Here will be described with attention to the situation where boom 7 is swiveling.

First, the premise in the present application will be briefly described.

Control apparatus 20 can recognize the position of remote operating terminal 13. This can be realized by the antenna of information relay device 42 having a directivity characteristic. Further, as described above, control apparatus 20 can recognize the swivel angle, the extension/retraction length, and the luffing angle of boom 7. Therefore, the control apparatus 20 can recognize the positional direction of the remote operating terminal 13 with respect to camera 41. Accordingly, control apparatus 20 can recognize angle α formed by the supporting direction of camera 41 by boom 7 and the positional direction of remote operating terminal 13 with respect to camera 41 (see FIG. 8). It should be noted that "the supporting direction of camera 41 by boom 7" is a direction along virtual line V1 (see FIG. 8) connecting swivel center M and camera 41 of boom 7 when viewed from above. Further, "the positional direction of remote operating terminal 13 with respect to camera 41" is a direction along virtual line V2 (see FIG. 8) connecting camera 41 and remote operating terminal 13 when viewed from above. In addition, control apparatus 20 is connected to an azimuth meter which is not shown, and can recognize the azimuth. The azimuth in the present application is represented by an azimuth symbol in FIG. 8.

As described above, boom 7 swivels in response to the manipulation of swivel manipulation tool 21 by operator Oa or the manipulation of swivel manipulation tool 61 by operator Ob. At this time, camera 41 swivels with boom 7. Then, aim point P of camera 41 will also swivel with boom 7 (see arrow N in FIG. 7), thus image area R1, R2 centered on aim point P will also swivel.

Figure 8:
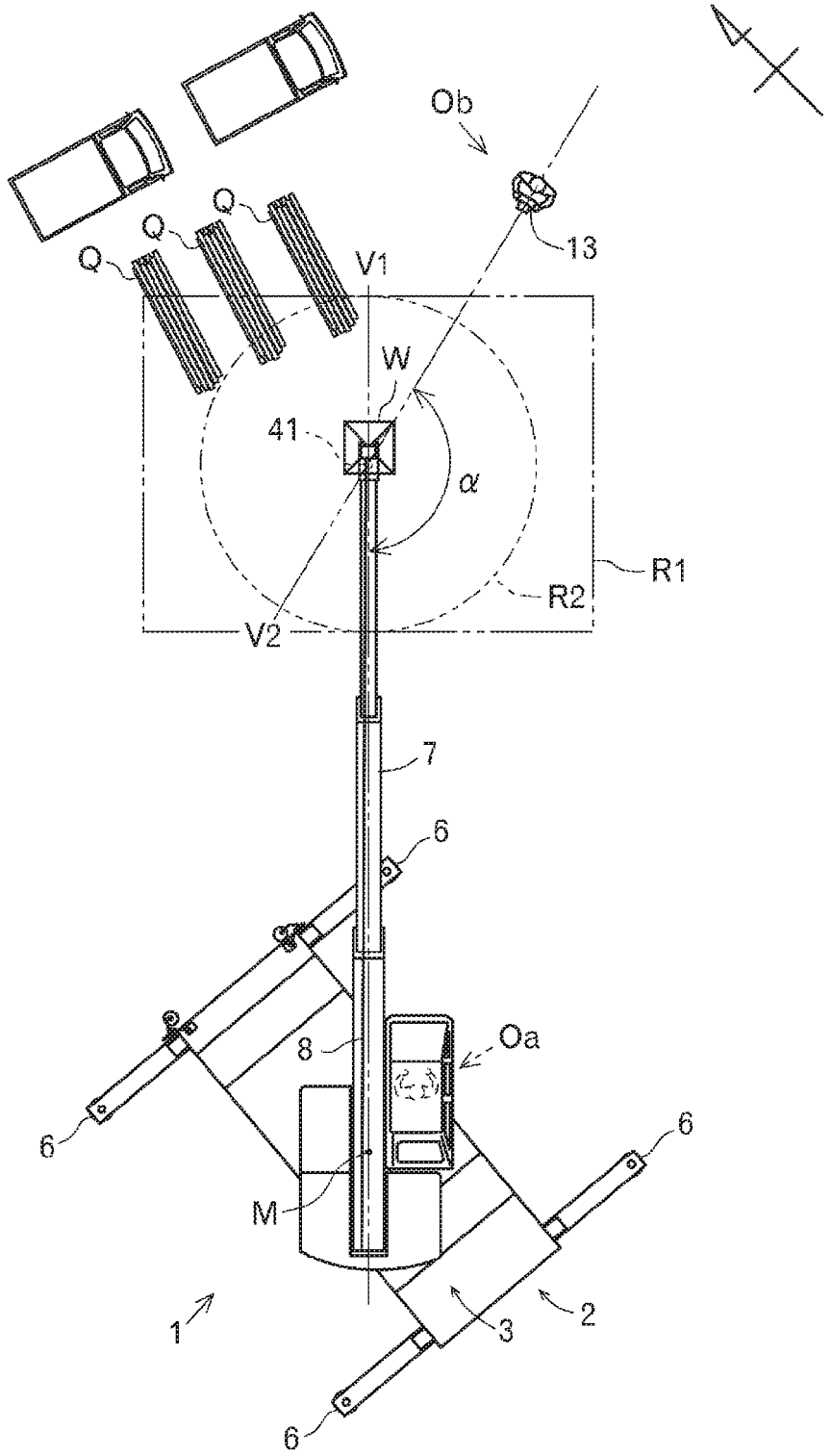
FIG. 8 illustrates a situation in which the boom is swiveling.

In the situation where boom 7 is swiveling, it is assumed that load Q placed on the ground is included inside image region R1 (see FIG. 8). Image region R1 is displayed on image display 43 provided inside cabin 11 (see FIG. 9A). Image region R1 has a rectangular shape inscribed in the photographing range of camera 41. This is intended to provide a broad view of the surrounding condition of hook 10 or load W suspended on hook 10.

At the same time, in the situation where boom 7 is swiveling, it is assumed that load Q placed on the ground is also included inside image region R2 (see FIG. 8). Image region R2 is displayed on image display 65 provided on the upper surface of remote operating terminal 13 (see FIG. 9B). Image region R2 has a circular shape inscribed in image region R1. This takes into consideration the fact that operator Ob can recognize that the image is turned and displayed, in addition to the fact that the image is not lost (no partially missing part of the image) even if the image is turned. The image is turned based on angle α. This is because directions are most easily recognized in the image by operator Ob.

Figure 9A:
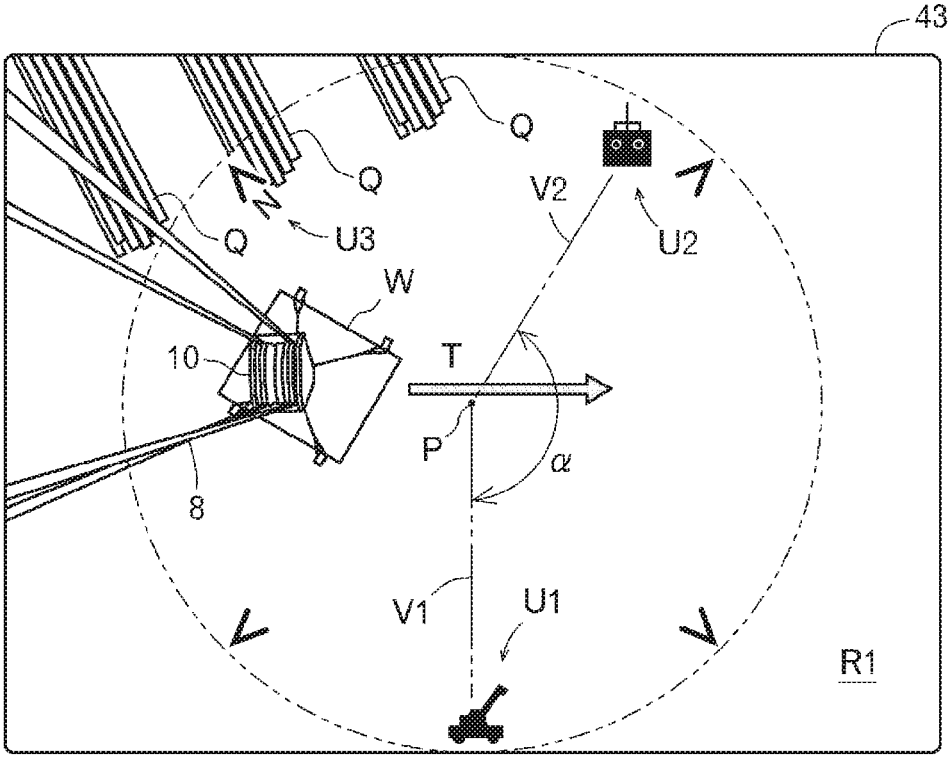
FIG. 9 illustrates a display aspect of a situation in which the boom is swiveling.
Figure 9B:
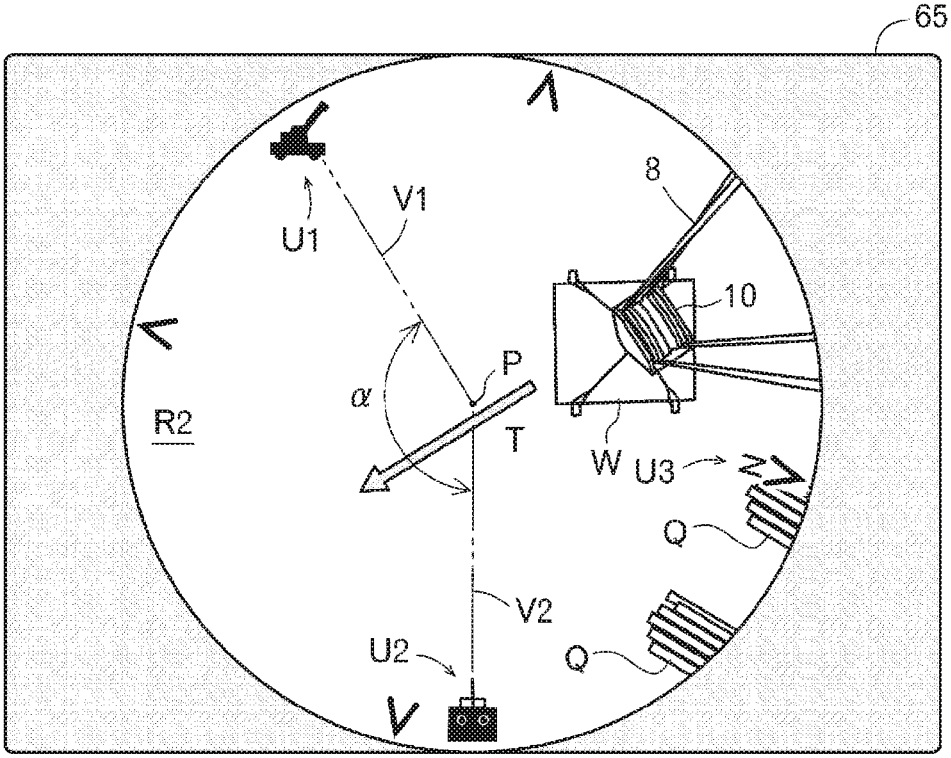

In addition, in image region R1 and R2, the moving direction of hook 10 or load W suspended on hook 10 is displayed by arrow-type image T (see FIGS. 9A and 9B). Considering that hook 10 or load W suspended on hook 10 is vertically downward at the distal end portion of boom 7, it can be said that such a moving direction is equal to the direction in which the distal end portion of boom 7 moves. The length of image T is appropriately adjusted in accordance with the moving speed. The color of image T may be changed in accordance with the acceleration/deceleration. Further, the mode of flashing image T or the like may be changed in accordance with the acceleration/deceleration.

In addition, marker U1 indicating the positional direction of traveling body 2 is displayed in image region R1, R2. Marker U2 indicating the positional direction of remote operating terminal 13 is displayed in image region R1, R2. Further, marker U3 indicating the azimuth is displayed in image region R1, R2.

The braking distance of boom 7 when operator Oa, Ob performs the swivel stop operation is calculated as follows. Here, the braking distance of boom 7 will be described as ΔΦ.

Braking distance ΔΦ of boom 7 is expressed by the following equation. At this time. "Φ" is the swivel speed of boom 7, and "T" is the load swing period. "Pnf" is the load swing reduction rate, and "Dcc" is the deceleration limit. It should be noted that swivel speed Φ' of boom 7 is detected by the sensor (see FIG. 6). Load swing period T, load swing reduction rate Pnf and deceleration limit Dcc will be described later.

$$\Delta\phi=|\phi'|T\,Pnf+\phi^2/2Dcc \qquad \text{[Equation 3]}$$

Load swing period T can be expressed using resonant frequency ω. Therefore, load swing period T is expressed by the following equation. Load swing reduction rate Pnf is a value determined by a function using notch width coefficient ζ and notch depth coefficient δ. Furthermore, the deceleration limit Dcc is a limit value when reducing the rotational speed of swivel hydraulic motor 31. Load swing reduction rate Pnf and deceleration limit Dcc can also be set to values determined for each model.

$$T=2\pi\sqrt{(L/g)} \qquad \text{[Equation 4]}$$

Further, the swing amount of load W is calculated by the following equation. Here, the swing amount (amplitude) of load W will be described as ΔΨ. Further, hook 10 and load W are regarded as a single rigid body, and then, the restoring force thereof is defined as F and the weight thereof is defined as M. However, in a situation where load W is not suspended on hook 10, the restoring force of hook 10 is F and the weight of hook 10 is M. Hook 10 and load W may be calculated as a double pendulum instead of being regarded as a single rigid bod.

$$\Delta\Psi=2F\ L/Mg \qquad \text{[Equation 5]}$$

Figure 10A:
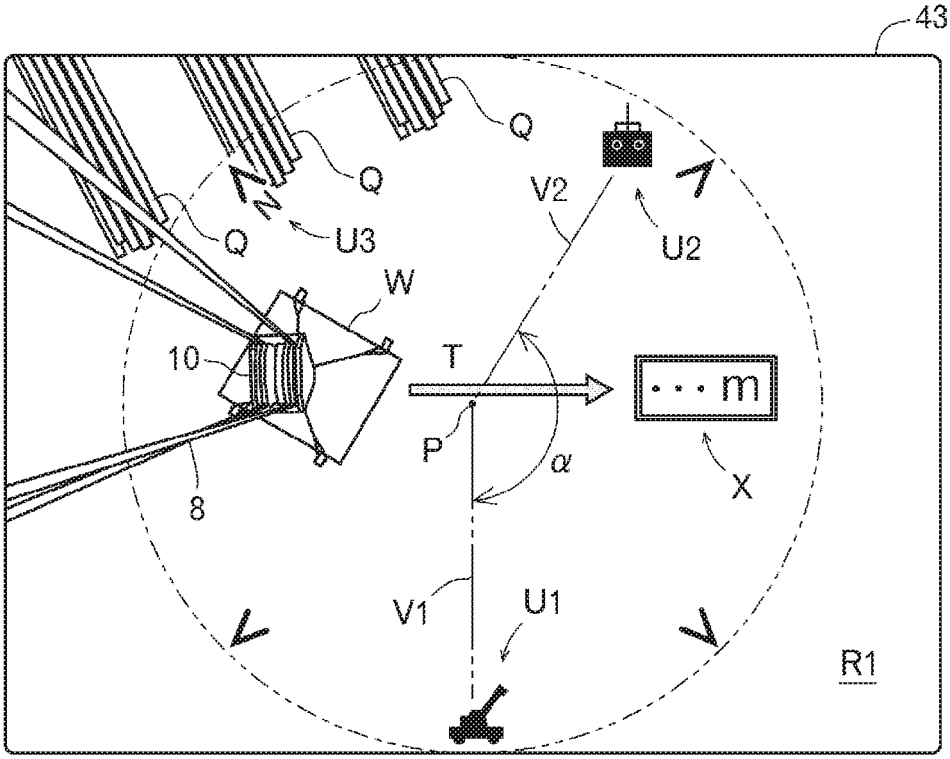
FIG. 10 illustrates a display aspect of a situation in which an operator performs a swivel stop operation.
Figure 10B:
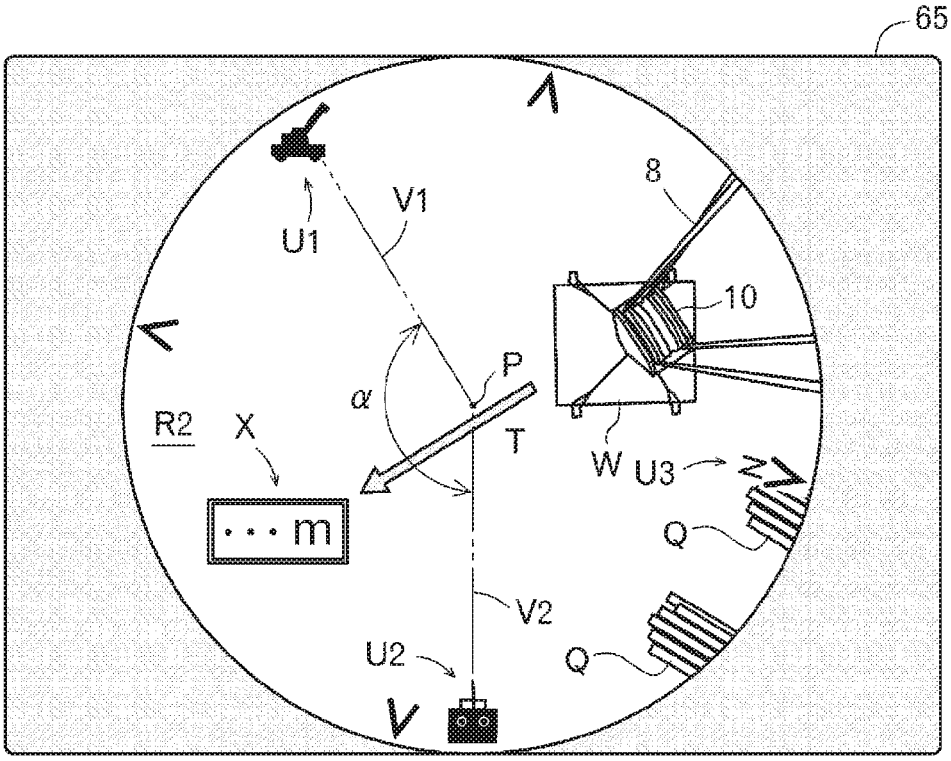
Figure 11A:
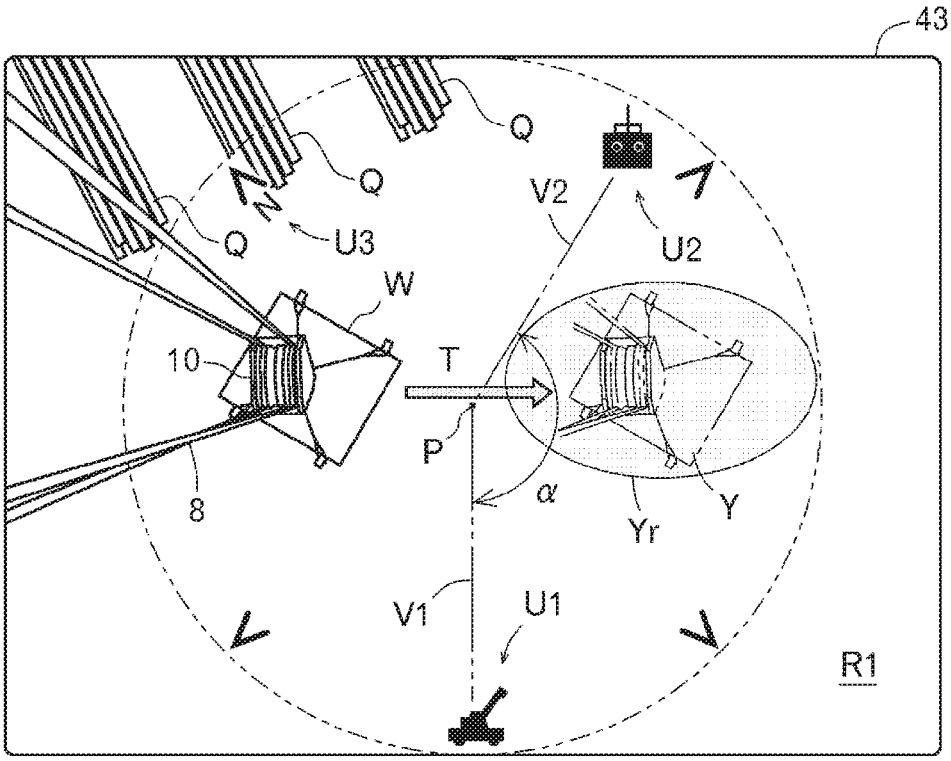
FIG. 11 illustrates a display aspect of a situation in which an operator performs a swivel stop operation.
Figure 11B:
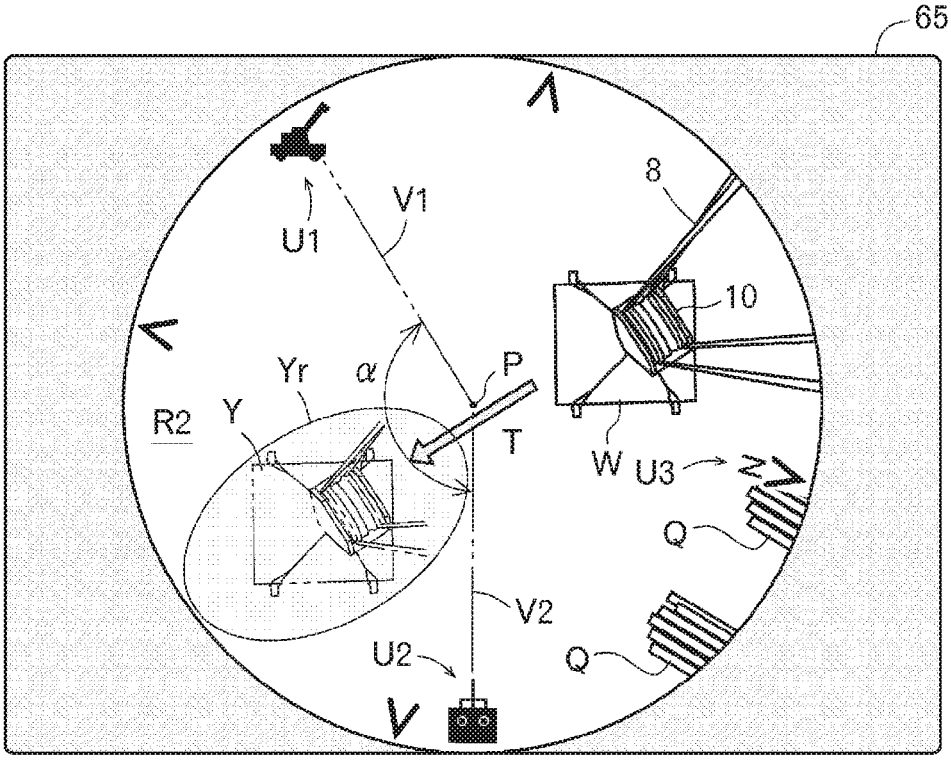
Figure 12A:
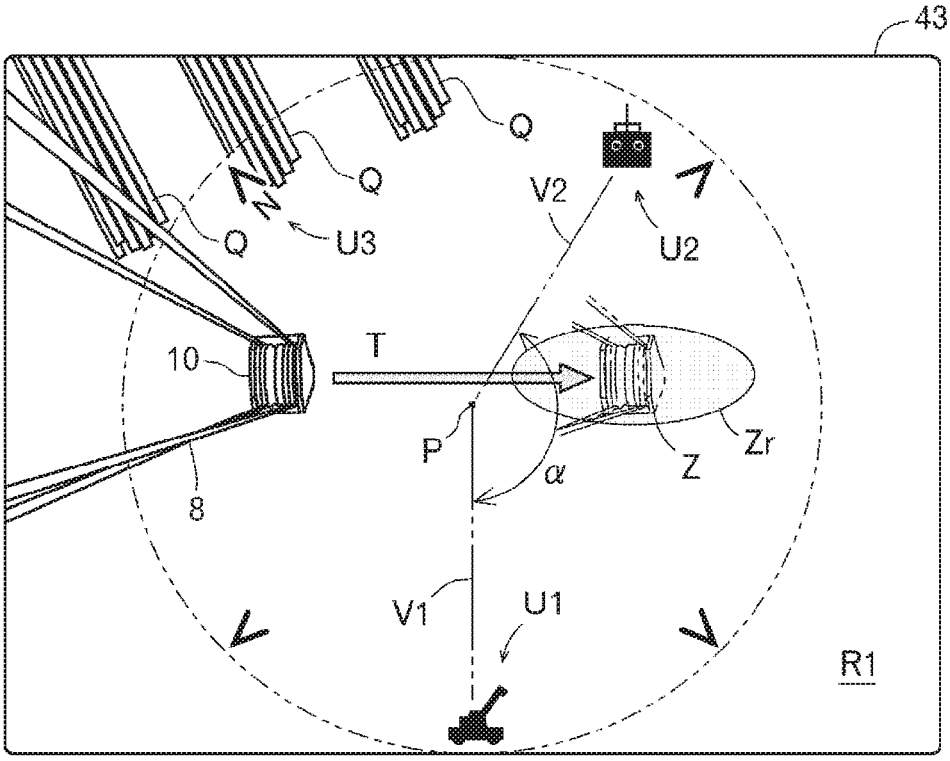
FIG. 12 illustrates a display aspect of a situation in which an operator performs a swivel stop operation.
Figure 12B:
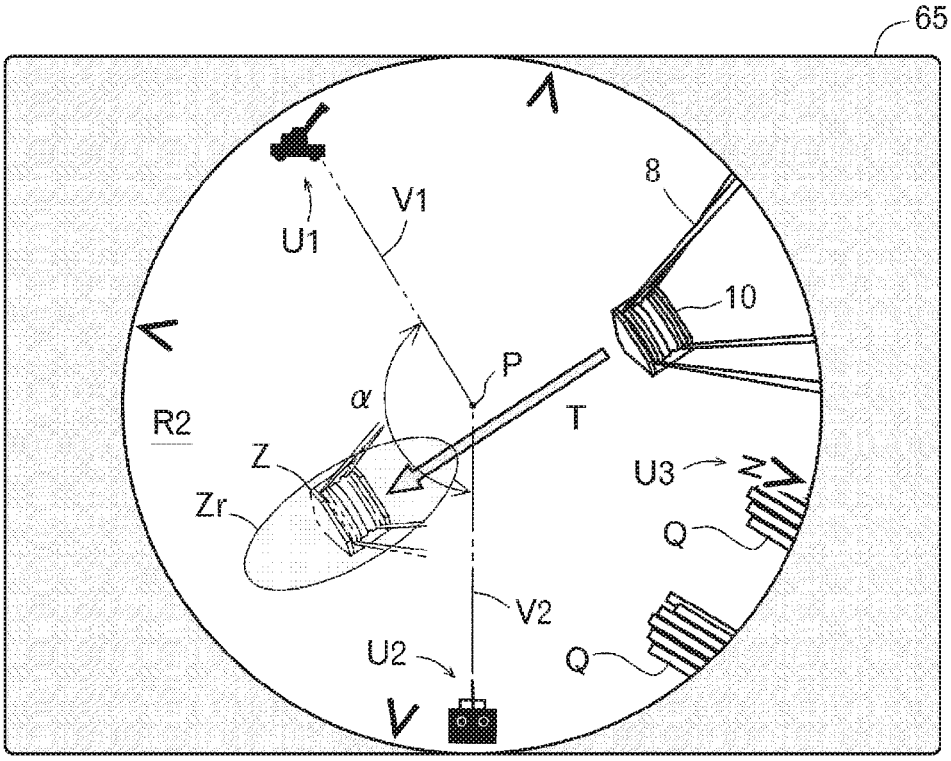

Next, with reference to FIGS. 10 to 12, the display mode in which the operator Oa, Ob performs the swivel stop operation.

As shown in FIG. 10, the braking distance of boom 7 is displayed in image region R1, R2. More specifically, since arrow-type image T extends in image region R1, R2, the braking distance of boom 7 is displayed on the extension line of image T. Considering that hook 10 or load W suspended on hook 10 is vertically downward at the distal end portion of boom 7, it can be said that the braking distance of boom 7 is equal to the braking distance of hook 10 or load W suspended on hook 10. Note that the value of the braking distance changes continuously in relation to the speed transition and the time transition. In the present application, the situation in which boom 7 swivels has been described, but the present invention is also applicable to a situation in which boom 7 extends or retracts and luffs up or down. Further, in addition to the swivel or the like of boom 7, it is also applicable to a situation where hook 10 ascends or descends.

Thus, crane 1 according to the present application includes the driving devices (31 to 34) for performing the operation of boom 7, control apparatus 20 for controlling the operating state of the driving devices (31 to 34), camera 41 for taking an image downward from the distal end portion of boom 7, and image display 43, 65 for displaying the image taken by camera 41. Then, in the case where the motion of boom 7 is stopped, control apparatus 20 generates filtered control signal Sf by applying filter F to basic control signal S of driving device (31 to 34), and controls drive device 20 based on filtered control signal Sf, and predicts the braking distance of boom 7 to display on image display 43, 65. According to such crane 1, operator Oa, Ob can grasp the surrounding condition of hook 10 or load W suspended on hook 10 by viewing image display 43, 65, and at the same time, can grasp the braking distance of boom 7. It is thus possible to perform an avoidance operation before hook 10 or load W suspended on hook 10 collides with a building or the like.

In this regard, since the present crane 1 can predict the position at which load W stops from the braking distance of boom 7, marker Y of load W may be displayed at such a position. Marker Y is obtained by cutting out the image of load W taken by camera 41, but is not limited thereto. For example, it may be a simple figure such as a circle or a rectangle.

As described above, in crane 1 according to the present application, control apparatus 20 predicts the position at which load W stops, and displays marker Y of load W on image display 43, 65. According to such crane 1, it is possible to easily determine whether load W collides with a building or the like from displayed marker Y of load W. Therefore, it is possible to perform the avoidance operation before load W collides with a building or the like.

In addition, since the present crane 1 can predict the swing amount (amplitude) of load W from deceleration of boom 7 or slinging length L of hook 10, swing range Yr of load W in consideration of such a swing amount may be displayed. Swing range Yr has a large elliptical shape in the moving direction of load W (elliptical shape having the long axis along the moving direction of load W), but is not limited thereto. For example, it may be a straight line indicating a range or the like.

As described above, in crane 1 according to the present application, control apparatus 20 predicts the swing amount of load W and displays the swing range Yr of load W on image display 43, 65. According to such crane 1, it is possible to easily determine whether load W collides with a building or the like from displayed swing range Yr of load W Therefore, it is possible to perform the avoidance operation before load W collides with a building or the like.

The above-mentioned technical idea can be applied even in a situation where load W is not suspended.

That is, since the present crane 1 can predict the position where hook 10 stops from the braking distance of boom 7, marker Z of hook 10 may be displayed at such a position. Marker Z is obtained by cutting out the image of hook 10 taken by camera 41, but is not limited thereto. For example, it may be a simple figure such as a circle or a rectangle.

As described above, in crane 1 according to the present application, control apparatus 20 predicts the position at which hook 10 stops, and displays marker Z of hook 10 on image display 43, 65. According to such crane 1, it is possible to easily determine whether hook 10 collides with a building or the like from displayed marker Z. Therefore, it is possible to perform an avoidance operation before hook 10 collides with a building or the like.

In addition, since the present crane 1 can predict the swing amount (amplitude) of hook 10 from deceleration of boom 7 or slinging length L of hook 10, swing range Zr of hook 10 in consideration of such a swing amount may be displayed. Swing range Zr has a large elliptical shape in the moving direction of hook 10 (elliptical shape having the long axis along the moving direction of hook 10), but is not limited thereto. For example, it may be a straight line indicating a range or the like.

As described above, in crane 1 according to the present application, control apparatus 20 predicts the swing amount of hook 10 and displays the swing range Zr of hook 10 on image display 43, 65. According to such a crane 1, it is possible to easily determine whether hook 10 collide with the building or the like from displayed swing range Zr of hook 10. Therefore, it is possible to perform an avoidance operation before hook 10 collides with a building or the like.

Finally, although the present application uses notch filter F as a filter for generating filtered control signal Sf, it is not limited thereto. That is, the band-stop filter which can attenuate or reduce by a specific frequency range is sufficient. For example, it is a band limit filter, a band elimination filter, or the like.

INDUSTRIAL APPLICABILITY

The present invention can be utilized for cranes.

REFERENCE SIGNS LIST

1 Crane
2 Traveling body
3 Swivel body
7 Boom
8 Wire rope
9 Winch
10 Hook
12 Operating system
13 Remote operating terminal
20 Control apparatus
31 Swivel hydraulic motor (Driving device)
32 Extension/retraction hydraulic motor (Driving device
33 Luffing hydraulic motor (Driving device)
34 Winding hydraulic motor (Driving device)
41 Camera
43 Image display
65 Image display
F Notch filter (Filter)
S Basic control signal
Sf Filtered control signal
W Load
X Braking distance of a boom
Y Marker of a load
Z Marker of a hook

The invention claimed is:

1. A crane that is configured to transport a load while suspending the load on a hook, the crane comprising:
- a boom;
- a wire rope hanging from the boom;
- the hook ascending and descending by winding and unwinding of the wire rope;
- a driving device for performing a motion of the boom;
- a control apparatus for controlling an operating state of the driving device;
- a camera for taking an image downward from a distal end portion of the boom; and
- an image display for displaying the image taken by the camera;
- wherein in a case where the motion of the boom is stopped, the control apparatus generates a filtered control signal by applying a filter to a basic control signal of the driving device and controls the driving device based on the filtered control signal, and predicts a braking distance of the boom to display the braking distance thereof on the image display.

2. The crane according to claim 1, wherein the control apparatus predicts a position at which the load stops and displays a marker of the load on the image display.

3. The crane according to claim 1, wherein the control apparatus predicts a swing amount of the load and displays a swing range of the load on the image display.

4. The crane according to claim 1, wherein the control apparatus predicts a position at which the hook stops and displays a marker of the hook on the image display.

5. The crane according to claim 1, wherein the control apparatus predicts a swing amount of the hook and displays a swing range of the hook on the image display.

* * * * *